US005271593A

United States Patent [19]

Kinner et al.

[11] Patent Number: 5,271,593

[45] Date of Patent: Dec. 21, 1993

[54] PIVOTAL KEYBOARD COPYHOLDER

[76] Inventors: Richard L. Kinner, 125 S. Shelburne Rd.; Ann K. McCrath, 16 Grant St., Greenfield, both of Mass. 01301

[21] Appl. No.: 899,088

[22] Filed: Jun. 15, 1992

[51] Int. Cl.[5] ..... B41J 11/02

[52] U.S. Cl. ..... 248/442.2; 248/289.1; 248/447; 248/918

[58] Field of Search ..... 248/447, 442.2, 296, 248/289.1, 289.3, 918, 297.3, 282, 278, 283

[56] References Cited

U.S. PATENT DOCUMENTS 4,632,471 12/1986 Visnapuu ..... 248/442.2 X
4,690,285 9/1987 Stone ..... 248/442.2 X
4,693,443 9/1987 Drain ..... 248/289.1 X
4,960,257 10/1990 Waters ..... 248/442.2
5,035,392 7/1991 Gross et al. ..... 248/918 X
5,082,235 1/1992 Crowther et al. ..... 248/442.2 X
5,104,088 4/1992 Bakanowsky, III ..... 248/442.2
5,122,941 6/1992 Gross et al. ..... 248/442.2 X

*Primary Examiner*—Ramon O. Ramirez

[57] ABSTRACT

The appartus includes a copyholder, mounted on a copyholder arm, held by the pivot block mounted on the platform. The copyholder is adjustable for viewing comfort through multiple set-ups and pivoting capabilities: in front, up or down, to the side, out of the way.

4 Claims, 5 Drawing Sheets

PIVOTAL KEYBOARD COPYHOLDER

FIELD OF INVENTION

The present invention relates to an accessory for use with a computer termina and more particularly, an accessory device for holding reference papers, papers being copied via keyboard into a computer, or other material associated with computer data entry.

BACKGROUND OF THE INVENTION

Copyholders are generally known and usually follow a prescribed format set from keyboarding schools and courses. Viewing the copy to the right side or left side of the keyboard and seldom, if ever, looking at the keyboard is generally taught as proper and most proficient. However, with the present day need for rapid data entry from specialized forms, the wide variety of software available and the variety of special function keys provided, the need to rapidly exchange copy paper as well as see and focus on the copy, the video terminal, and the keyboard in succession are now commonly necessary, and this requires that the copyholder be position adjustable including a position directly in front and over the keyboard. The need to rapidly exchange copy forms requires that one hand remove copy from the holder while the other hand simultaneously moves new copy to the holder.

Computer frames, disc drives, monitors, keyboards, and support furniture vary significantly. Copyholders that stand on the desk surface are not useful on small PC work stations or terminal stands, and those that clamp to a desk edge do not work if the desk has no usable edge, as on roll-away work stations or wide, multiple terminal counters. Adhering a copyholder to the case of a monitor causes derogation of the monitor's appearance and is not acceptable for multiple user company property or rental monitors. Copyholders that are held by slipping a foot under one side of the monitor or disc drive can cause distraction by tipping the monitor or causing the monitor to be unstable and to rock. If the copyholder foot is thinner than the depth of legs on the monitor, the copyholder will be unstable and need a wedge or other effort to be useful.

Copyholders with holding clips or line guides generally need two hands to operate, and the guides are in the way for inputting on one side and outputting on the other. The clips are also in the way when the copyholder plate is inverted for alternate viewing locations.

A primary object of this invention is to provide a copyholder that will permit a very rapid manual exchange of copy material and hold the material in an ergonomically satisfactory position during data entry.

Another object of the present invention is to provide a copyholder that overcomes the unsatisfactory features of the prior art.

A further object of the present invention is to be able to make said copyholder without needing expensive tooling such as dies and fixtures and thereby allowing low start-up costs.

Another object is to provide a durable copyholder that is simple and convenient to operate.

SUMMARY OF THE INVENTION

The present invention includes a semitransparent plate with a light diffusing, also termed non-glare, surface for supporting the copy material. The plate has edge lips and is rotatably mounted to a rod or pipe arm that has a 90 degree bend. The arm is pivotably and slidably supported from aligned receiving holes in both a corner block and a rigid board or platform. The corner block is in turn supported by being rigidly mounted at a selectable position to the board or platform which is of a size such that it may be used to steadily support the video monitor. Additional features may be apparent from the drawings or their detailed description.

DESCRIPTION OF THE DRAWING FIGURES

FIG. 1 is an exploded pictoral of the invention showing one selectable arrangement of the major components.

FIGS. 2,3,4, and 5 are partial pictorals showing various selectable arrangements for the location of the support block 5 and arm 2.

DESCRIPTION OF THE PREFERRED EMBODIMENT

Figure 1:
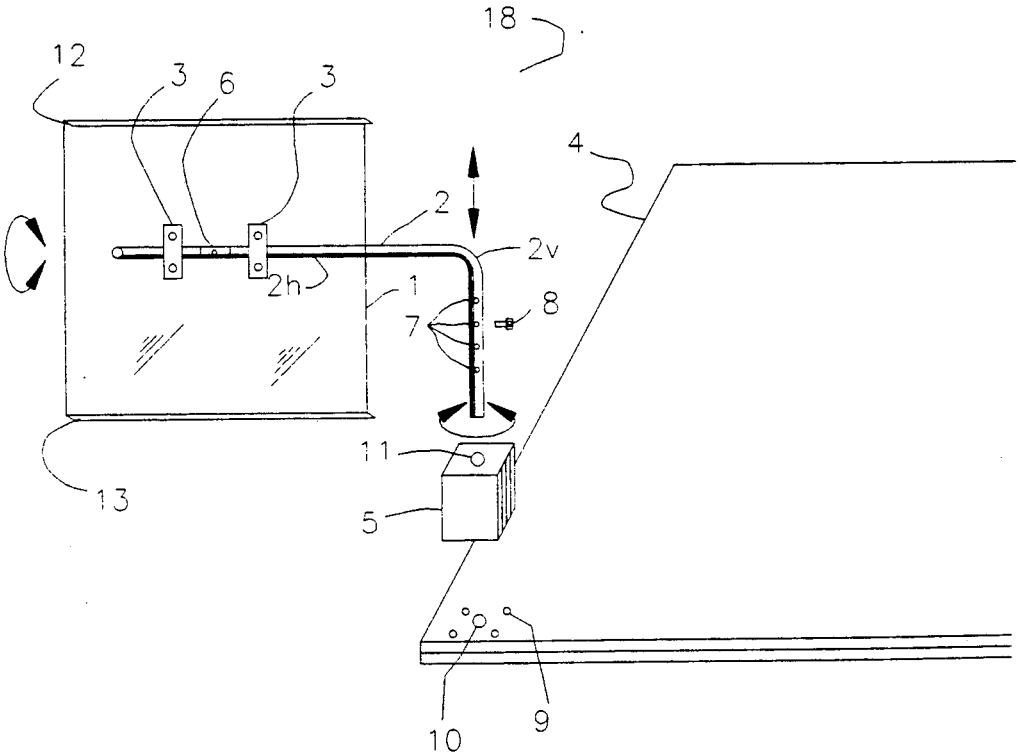

In FIG. 1, the semitransparent plate 1 is shown with two parallel edges bent to form copy support lips 12 and 13. Mounting clips 3 attach the plate 1 to an arm 2 of circular cross section such that the copy support lips 12 and 13 are parallel to arm section 2*h*. Mounting clips 3 may be selectably tightened to allow plate 1 to rotate about arm 2*h*, but being rotationally limited by selectably positioned stop collar 6. Arm 2 as shown includes a horizontal portion 2*h* and a vertical portion 2*v* with the vertical portion 2*v* having holes 7 to selectably receive a stop screw 8. The position of stop screw 8 controls the elevation of the copyholder assembly 18 by limiting the distance arm 2 may penetrate the pivot block 5 through the arm support hole 11 and the platform board 4 through the board hole 10 aligned with hole 11.

Figure 2:
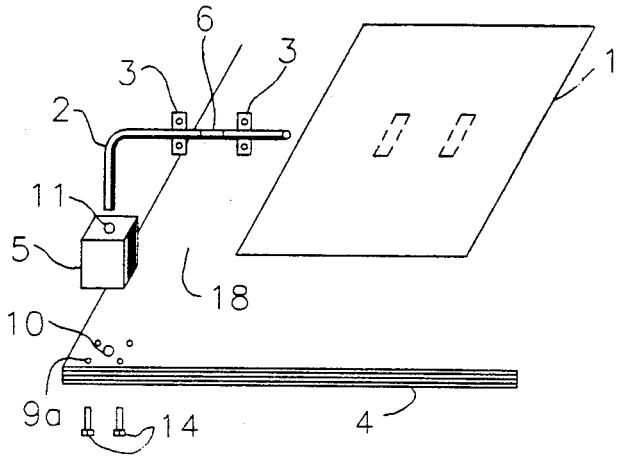
Figure 7:
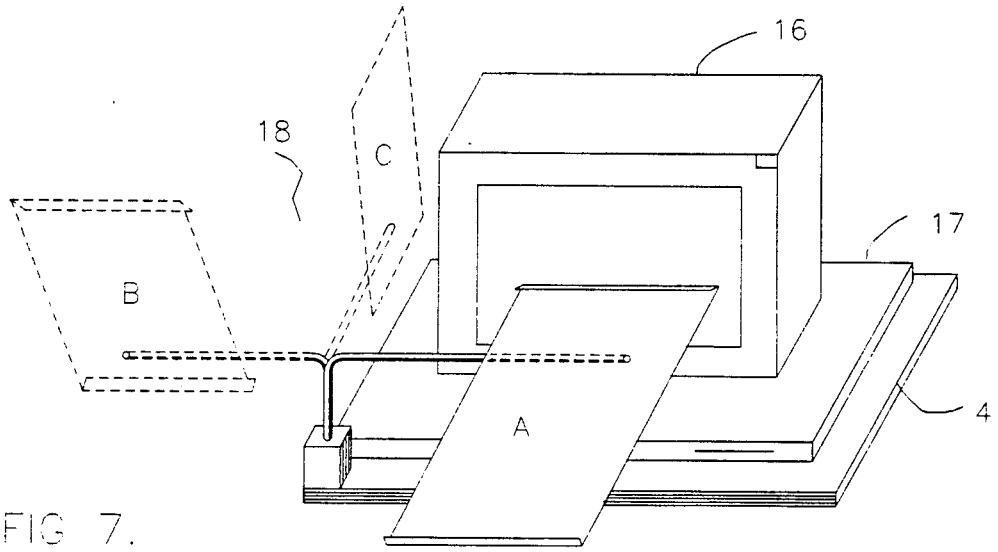
FIG. 7 is a pictoral showing one application selection as represented in FIG. 2 complete with a computer and alternate copyholder positions shown in phantom.

In FIG. 2, the pivot block 5 is shown as to be mounted by screws 14 through holes 9*a* to the top left side of the platform board 4 which selects high, relative to the platform board 4, leftsided positions for the copyholder assembly 18 and also selects a flat bottom for placing the invention on a desk or table as shown in FIG. 7.

Figure 3:
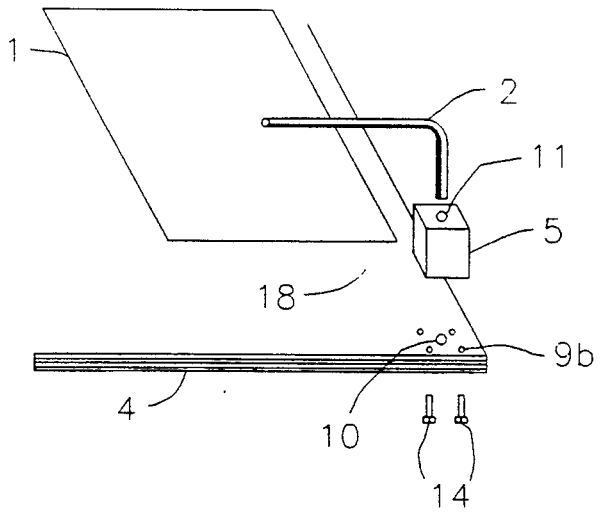

In FIG. 3, the pivot block 5 is shown as to be mounted by screws 14 through holes 9*b* to the top right side of the platform board 4 which selects high, relative to the platform board 4, rightsided positions for the copyholder assembly 18 and also selects a flat bottom for placing the invention on a desk or table.

Figure 4:
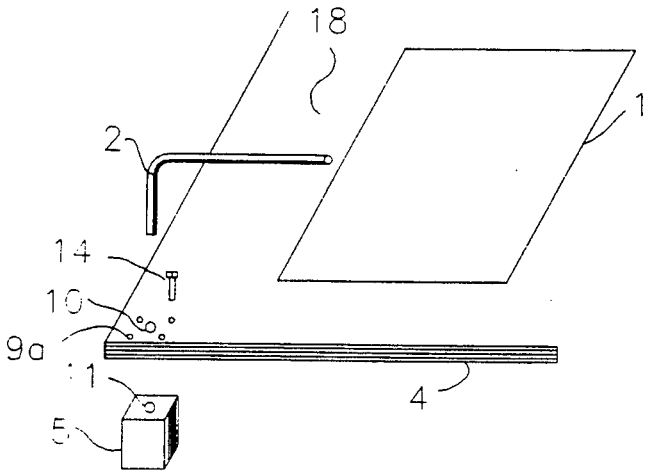
Figure 8:
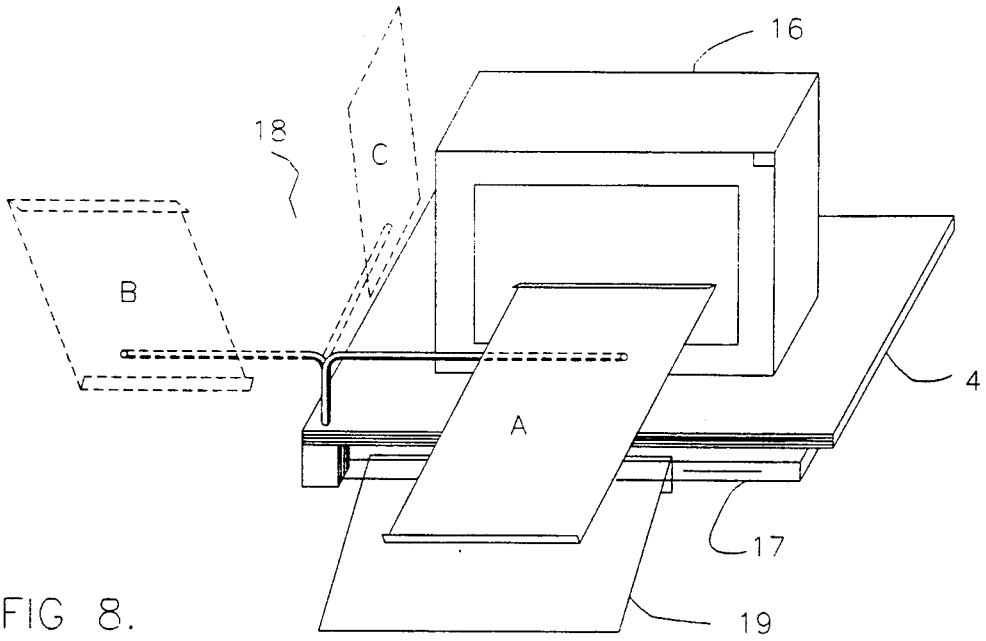
FIG. 8 is another pictoral showing a second set-up application selection as represented in FIG. 4.

In FIG. 4, the pivot block 5 is shown as to be mounted by screws 14 through holes 9*a* to the bottom left side of the platform board 4 which selects low, relative to the platform board 4, leftsided positions for the copyholder assembly 18 and also selects a configuration suitable for placing the invention on top of a disc drive or monitor stand as shown in FIG. 8

Figure 5:
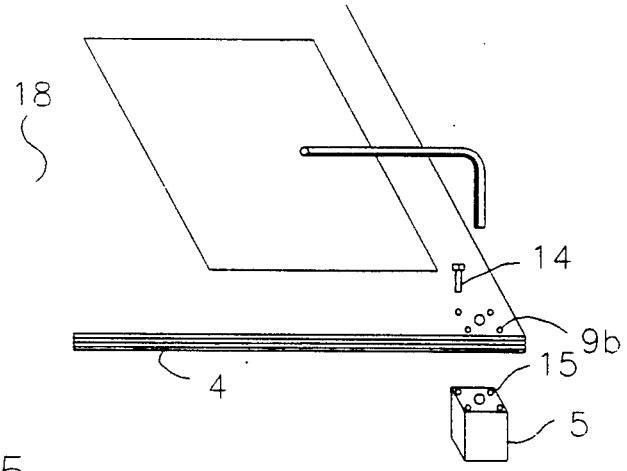

In FIG. 5, the pivot block 5 is shown as to be mounted by screws 14 through holes 9*b* to the bottom right side of the platform board 4 which selects low, relative to the platform board 4, rightsided positions for the copyholder assembly 18.

Figure 6:
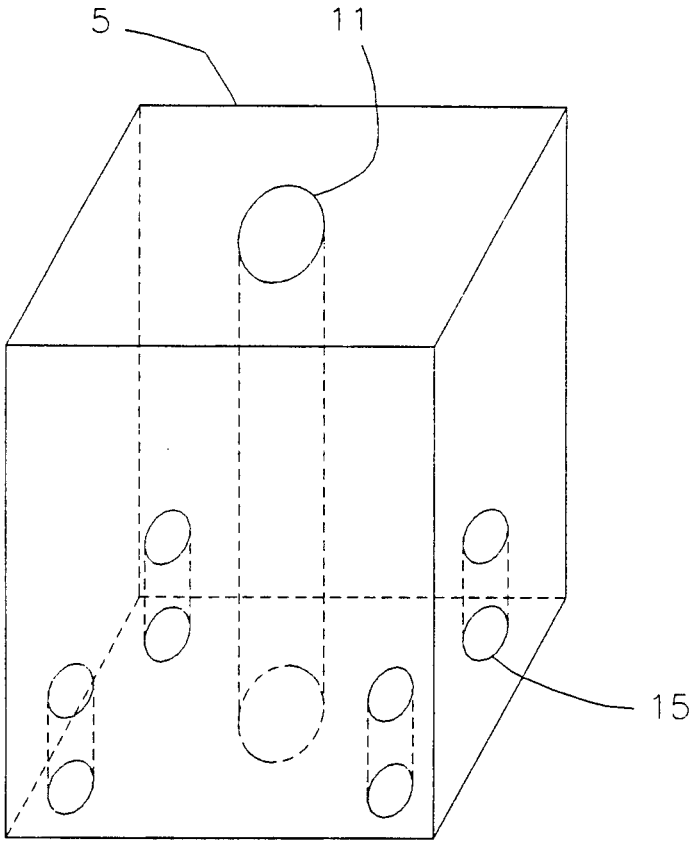
FIG. 6 shows the support block 5 and various features in phantom.

In FIG. 6, the pivot block 5 is detailed showing the through arm support hole 11 and block mount holes 15.

In FIG. 7, the invention is show with a video monitor 16 and computer disc drive or monitor stand 17 placed on top of the platform board 4. Pivotally selected positions for the copyholder assembly 18 and rotationally selected positions for the copyholder plate 1 are shown as varying from position A, which is a low angle in front of the monitor 16, through position B, which is a high angle at the side of the monitor 16, to position C, which is back out of the way close to the monitor 16.

In FIG. 8, the same pivotal positions for copyholder assembly 18 are shown as in FIG. 7, but the platform board 4 and monitor 16 are shown on top of the computer disc drive or monitor stand 17. The copyholder plate 1 is shown in position A as being in front of the operator (not shown) and over the computer keyboard 19.

It can be appreciated from the drawings, common knowledge, and the above description that all parts of this invention can be made as assembled using simple tools found in any common wood or cellar shop. A drill press and wood or metal bits make all the holes, the arm 2 can be made from two pieces of pipe and an elbow or bent from a round bar, and the plate 1 can be formed from a sheet of plexiglass bent over wood blocks after heating with a hairdryer. The non-glare surface can be added by systematically rubbing the plexiglass with a very fine sandpaper or wire brush.

We claim:

1. A copyholder for holding copy materials being manually entered through a computer keyboard and that is of the type that is held stable by weight of a computer monitor and is selectably positionable comprising:

a platform board, a pivot block selectably attached to said platform board with both said pivot block and said platform board each having a hole alignable to make a single through hole when assembled, an arm having a vertical axis and a horizontal axis positioned in said through hole and pivotably supported by said pivot block and said platform board allowing pivotal motion about the arm's said vertical axis, a plate for holding and surrounding copy materials, said plate being rotatably connected to said arm with the arc of rotation of said plate being concentric with said horizontal axis of said arm, and wherein a synergistic effect of pivoting and rotating allows at least one useful copy holding position of the plate to be directly over at least a part of the computer keyboard with said plate selectably disposed in nearly horizontal positions.

2. The copyholder of claim 1 wherein said plate has two lips for retaining copy material when the disposition of said plate is adjusted to more vertical positions, and said synergistic effect of pivoting and rotating also allows at least a second useful copy holding position of the plate to be beside the monitor and at a steep angle.

3. The copyholder of claim 2 further comprising means for adjusting the elevation height of said arm and thereby selecting a height for said plate, and means for selectably stopping the rotation of the copyholder plate at a desired and repeatable angle.

4. The copyholder of claim 2 wherein said plate has enough transparency to allow at least visually sensing the location of keyboard function keys when said plate is positioned directly over a keyboard, and said plate has a non-glare surface.

* * * * *

UNITED STATES PATENT AND TRADEMARK OFFICE

CERTIFICATE OF CORRECTION

PATENT NO. : 5,271,593

DATED : December 21, 1993

INVENTOR(S) : Kinner, et al

It is certified that error appears in the above-indentified patent and that said Letters Patent is hereby corrected as shown below:

On the title page, item [76] Inventors: "Ann K. McCrath" should read -- Ann K. McGrath --.

Signed and Sealed this

Twentieth Day of September, 1994

*Attest:*

Bruce Lehman

BRUCE LEHMAN

*Attesting Officer*

*Commissioner of Patents and Trademarks*